US005226252A

United States Patent [19]

Haluska

[11] Patent Number: 5,226,252

[45] Date of Patent: Jul. 13, 1993

[54] PHOTOFRAME KEYCHAIN

[75] Inventor: Charles C. Haluska, Walnut, Calif.

[73] Assignee: The Magni Group, Inc., McKinney, Tex.

[21] Appl. No.: 657,108

[22] Filed: Feb. 15, 1991

[51] Int. Cl.[5] ..... G09F 15/00

[52] U.S. Cl. ..... 40/634; 40/661; 70/456 R; 206/38.1

[58] Field of Search ..... 40/330, 634, 661, 5, 40/152; 70/456 R, 460; 206/37.8, 38.1

[56] References Cited

U.S. PATENT DOCUMENTS

| | | | |
|---|---|---|---|
| D. 227,848 | 7/1973 | Schneider . | |
| D. 311,456 | 10/1990 | Grossbart . | |
| 2,000,419 | 5/1935 | Sarber | 40/660 X |
| 2,928,195 | 3/1960 | Fischer | 40/634 X |
| 3,094,799 | 6/1963 | Hines | 40/634 |
| 3,306,266 | 2/1967 | McCunney | 40/660 X |
| 3,561,146 | 2/1971 | Dembar . | |
| 3,703,045 | 11/1972 | Nyman | 40/152 |
| 3,774,332 | 11/1973 | Schneider | 40/152.1 |
| 4,100,779 | 7/1978 | Schachter . | |
| 4,195,729 | 4/1980 | Macken | 40/152 X |
| 4,789,073 | 12/1988 | Fine | 40/324 X |
| 4,979,325 | 12/1990 | White | 40/324 X |
| 5,033,141 | 7/1991 | Kang | 70/456 R X |

FOREIGN PATENT DOCUMENTS

| | | | |
|---|---|---|---|
| 1249289 | 11/1960 | France | 40/634 |
| 115095 | 4/1918 | United Kingdom | 40/660 |

OTHER PUBLICATIONS

Advertisement page from Elegen Company Limited, Hong Kong from Mar. 1985.

*Primary Examiner*—James R. Brittain
*Assistant Examiner*—Brian K. Green
*Attorney, Agent, or Firm*—Charles Berman

[57] ABSTRACT

A photoframe together with a keychain wherein the cube acts as a picture frame for multiple photographs. Two separate interengaging mating cubic structures provide for the location of the photograph between the side walls of the cubic structures. An anchorage element is located in the top wall of one of the elements. A photoframe for three dimensional photograph displays with a key ring is provided.

8 Claims, 4 Drawing Sheets

PHOTOFRAME KEYCHAIN

BACKGROUND

Displaying photographs in different attractive manners is highly desirable.

This invention relates to a picture frame for photographs for use in conjunction with means for holding keys.

Different techniques for displaying multiple photographs are known. Also, many different fobs for location at the end of a keychain are known.

The present invention seeks to provide a frame with a novel combination of fob and means for displaying photographs, together with means for holding keys.

SUMMARY

According to the invention, there is provided a frame for holding multiple photographs comprising a body having a planar surface for supporting at least a first photograph. The planar surface extends in at least three dimensions and preferably forms a cube.

Anchorage means is affixed to the body. An element is connected with the anchorage means at one end of the element and there is means for releasably holding keys at an opposite end of the element.

Further, according to the invention, there is provided a mating cube structure with faces parallel to the surfaces of the first cube structure and the photographs are sandwiched between the surfaces and the faces.

The invention is further described with reference to the accompanying drawings.

DRAWINGS

Figure 3:
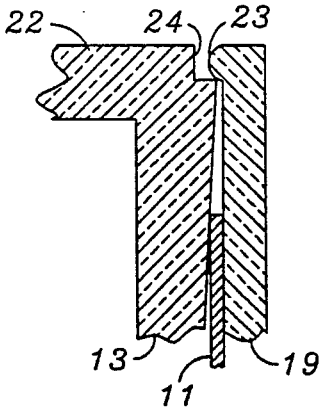

FIG. 3 the interlocking formations of the two cube structures.

Figure 4:
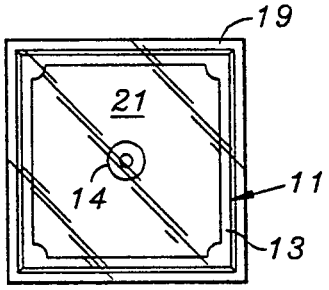

FIG. 4 an underview of the frame in the assembled position.

Figure 5:
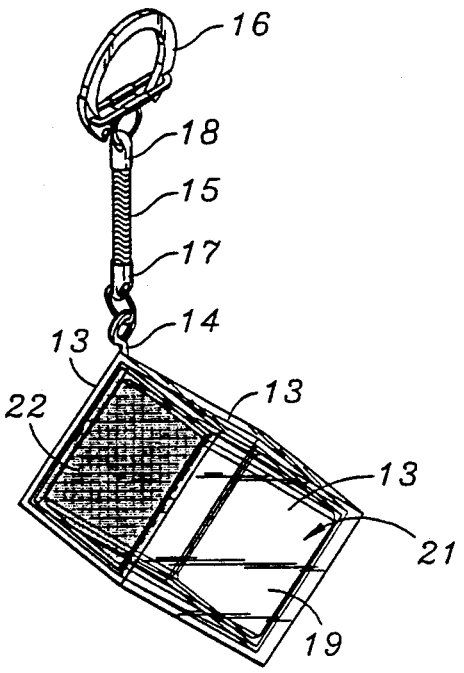

FIG. 5 a perspective view in assembled position of another embodiment of the frame, namely, an elongated cube structure.

Figure 6:
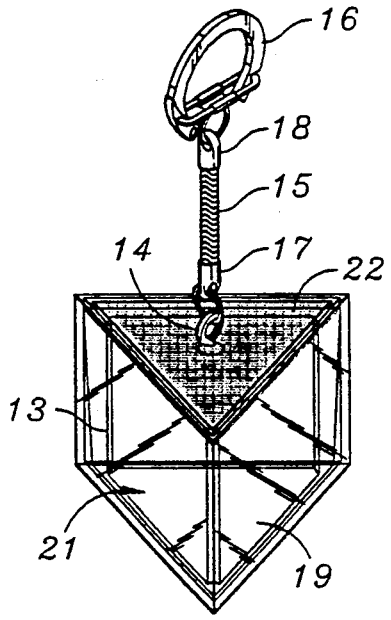
Figure 6A:
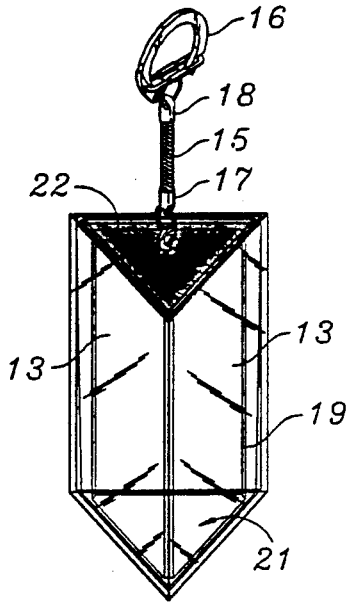

FIG. 6 is a perspective view in assembled position of another embodiment of the frame, namely, a triangulated cube FIG. 6*a* is a perspective view of an elongated version of the embodiment of FIG. 6.

Figure 7:
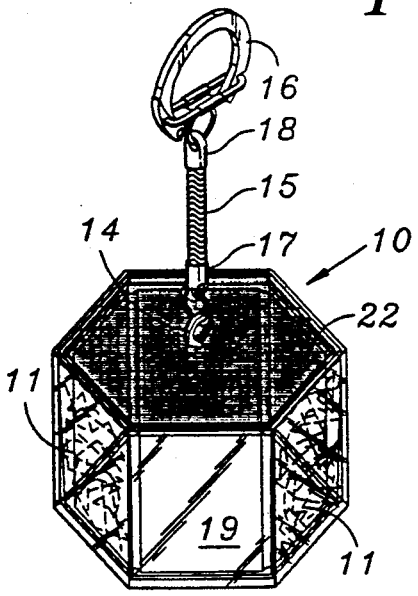

FIG. 7 is a perspective view in assembled position of another embodiment of the frame, namely, a hexagonal cube structure.

Figure 8:
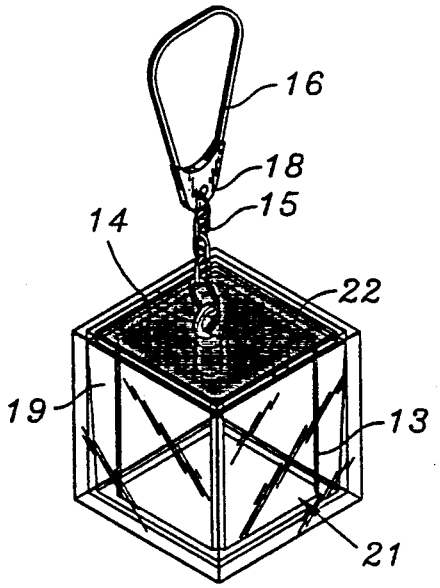

FIG. 8 is a perspective view in assembled position of another embodiment of the frame, namely, a regular cube with a different elongated member and key fob.

Figure 8A:
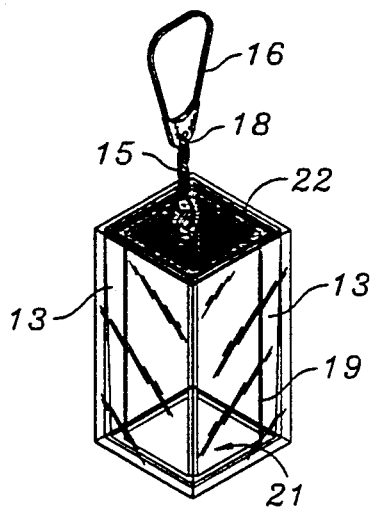

FIG. 8*a* is a perspective view of an elongated version of the embodiment of FIG. 8.

Figure 9:
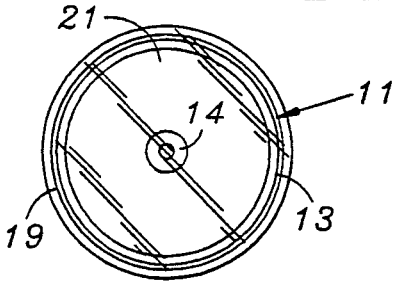

FIG. 9 is an underview in assembled position of another embodiment of the frame, namely, a circular structure.

Figure 10:
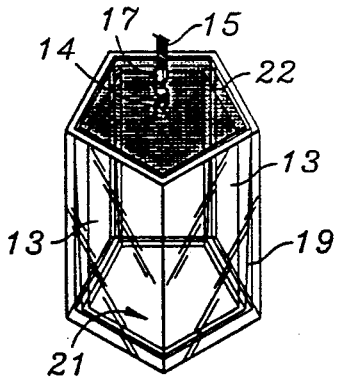

FIG. 10 is a perspective view in an assembled position of a five-sided embodiment.

Figure 11:
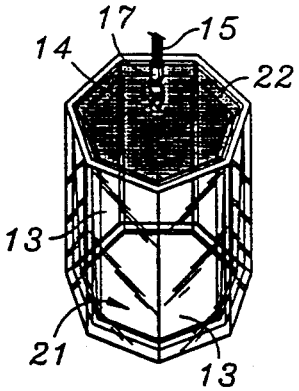

FIG. 11 is a perspective view in an assembled position of a seven-sided embodiment.

Figure 12:
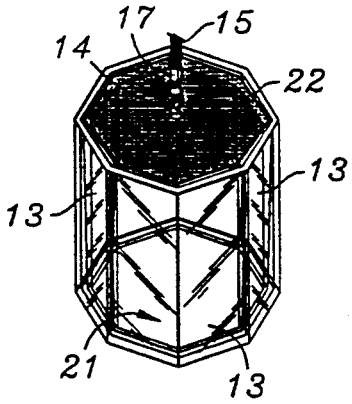

FIG. 12 is a perspective view in an assembled position of an eight-sided embodiment.

Figure 13:
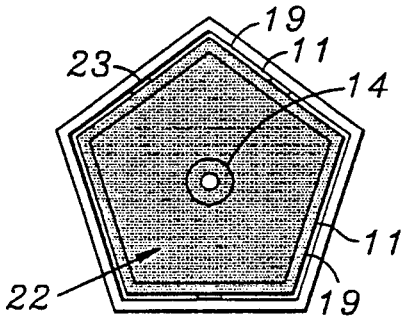

FIG. 13 is a top view of a five-sided embodiment with the elongated element removed but with photographs in place.

Figure 14:
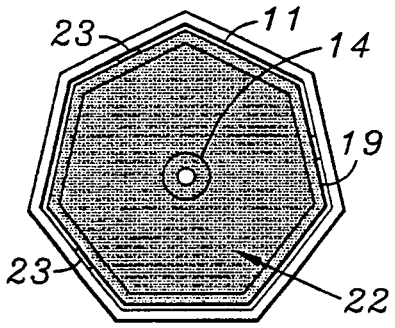

FIG. 14 is a perspective top view in an assembled position of a seven-sided embodiment.

Figure 15:
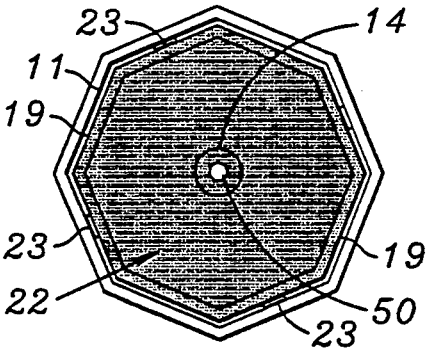

FIG. 15 is a perspective top view in an assembled position an eight-sided embodiment.

DESCRIPTION

In the preferred embodiment, a key fob and frame 10 for holding multiple photographs 11 comprises a cubic body 12 having a planar surface 13 for supporting at least a first photograph. Planar surfaces 13 extend in at least three dimensions to form a cube structure. Two respective planar surfaces 13 form at least an acute angle relative to each other.

Figure 1:
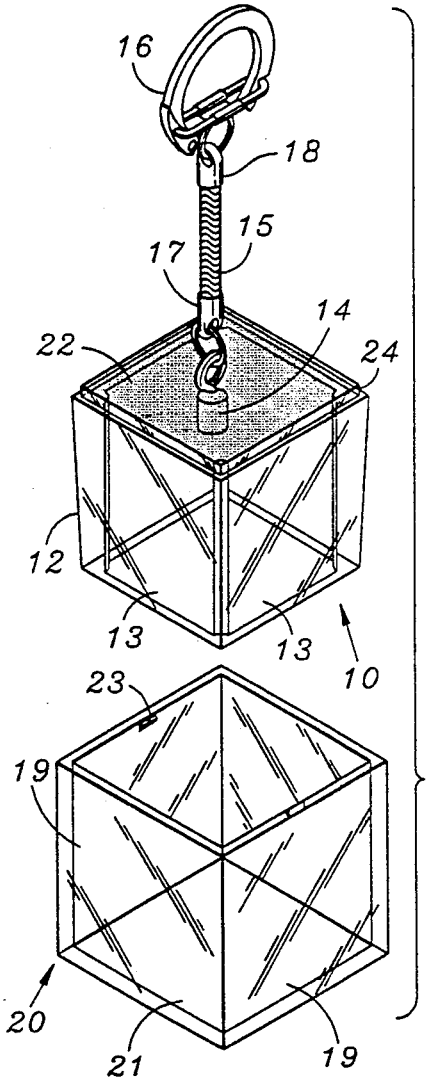
FIG. 1 is a perspective view of the frame with the two regular cube structures apart.
Figure 2:
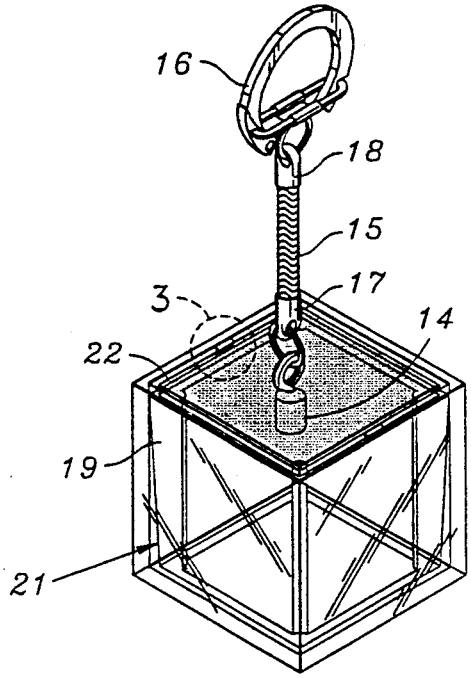
FIG. 2 is a perspective view of the frame with the two cube structures together.

By the term "angle", the Applicant means an angle greater than zero degrees, namely, an angle wherein the surfaces are non-parallel to each other. In FIGS. 1, 5 and 8, the angle is represented by about 90°. In FIG. 6, a acute angle is about 60°, namely, the inner structure is triangulated. In FIG. 7, the angle is greater than 90°, The angle permits for a hexagonal structure.

Anchorage means 14 are affixed to the body 12 and an elongated element 15 is connected with the anchorage means 14 at one end 17 of the element 15. There is a ring or catch means 16 for releasably holding keys at an opposite end 18 of the element 15.

The frame 10 also includes a second cube structure 20 with planar faces 19 matingly associated in parallel relationship with the planar surfaces 13. This secures photographs 11 between the planar surfaces 13 and the mating parallel faces 19. The faces 19 form a cubic structure 20. The second cubic structure 20 includes a bottom wall 21.

In the illustrated form, there is a first pair of planar surfaces 13 and faces 19 for supporting between them at least the first photograph 11 and a second pair of planar surfaces 13 and faces 19 for supporting between them the second photograph 11.

In the various forms, the planar surface 13 and faces 19 close on themselves. In some forms, the planar surface is at least partly curved or circular as illustrated in FIG. 9. In other forms, the planar surfaces 13 form part of two sides of a first cubic structure 12. The first cubic structure 12 includes at least three, and preferably four, sides 13. The first cubic structure 12 includes at least a top wall 22 and the anchorage means 14 is connected with the top wall 22 by means of a screw connection threaded into the wall 22. A suitable aperture 50 may be provided in the top wall 22 for the anchorage means 14. The anchorage 14 may be a shaft member and an eye into which the end 17 is connected.

The second cubic structure 20 includes locking means 23. The first cubic structure 12 includes locking elements 24 and the locking means 23 and locking elements 24 interengage thereby to secure the two cubic structures 12 and 20 together. The interengaging locking means 23 and locking elements 24 are, respectively, a protruding element and a recessed element. The recessed element 24 extends at least partly about the periphery of the planar surface 13 at the interface with the top wall 22. The locking means 23 and locking elements 24 may extend in part or in whole along the periphery of the interface.

The anchorage means 14 is located in the top wall 22 of the first cubic structure 12 in the embodiments of FIGS. 1, 3, 4, 7, 8, 9, 10, 11, 12, 13, 14 and 15. In an alternative construction as illustrated in the embodiment of FIG. 5, the anchorage means 14 is located at the interface between adjacent surfaces 13 and the top wall 22 of the body 12.

The first cubic structure 12 and the second cubic structure 20 forms a mating structure so that when the two cubic structures 12 and 20 are in mating engagement, the structures 12 and 20 form a relatively closed construction. The structure 12 is hollow as illustrated; however, it may be solid as required. The photographs 11 are located, for instance, by being slid into position between the surfaces 13 and 19. Alternatively, the photographs are placed on surface 13, and then the mating cubic structure 20 is slipped into mating position over the first cubic structure 12. Interlocking is effected with structures 23 and 24 and the photographs are thereby held securely in position.

With the locking structures for locating the intersecting cube structures 12 and 20 together, a firm position engagement of structures for the cube photoframe is obtained. This is particularly important after operation with the elongated element 15 and key ring 16 since there is a lot of pressure on and movement with the key fob 10. Hence, as the key fob 10 is handled manually, it is important that the cubes 13 and 20 not be able to slip open and permit the photographs 11 to fall out. Similarly, the anchorage must be of a nature to permit positive and firm engagement with the frame 10, and thereby permit inadvertent disassembly of the component parts 13 and 20.

Many other forms of the invention exist each differing from the other in matters of detail only. For instance, in some cases, there may be only a single cubic body 13 and means for securing the photographs to the body, the cubic structure being three dimensional. Photographs can be displayed in multiple directions, for instance, front, back and sides. The three-dimensional effect has front, back and depth views.

In other cases, different three dimensional structures can be provided, for instance, regular, irregular, pentagonal, septagonal or octagonal structures with or without fully or partly curved surfaces can be used.

The regular pentagonal structure is illustrated in FIGS. 10 and 13; the regular septagonal structure is illustrated in FIG. 11 and 14; and the regular octagonal structure is illustrated in FIGS. 12 and 15. The length or height of the sides 13 can vary relative to the area of the top wall 22. Thus, the height and length relative to the top wall may provide an appearance ranging from relatively squat to relatively elongated. Also, the curved surface may be smooth or irregular, convex or concave and may vary from a regular circle to an oval shape, and be wholly curved. Alternatively, it can be curved in combination with straight sides.

Likewise, instead of right angularly arranged bottom 21 and top 22 portions relative to the surfaces 13 and 19, respectively, the bottom 21 and top 22 can be arranged at a different angular relationship. Essentially, the frame is three-dimensional to permit multiple photographs at different angles to be affixed relative to the key ring 16.

The invention is to be determined solely in terms of the following claims.

I claim:

1. An article for holding multiple photographs comprising a body having a first surface for supporting at least a first photograph, a second surface for supporting a second photograph and wherein the two respective surfaces are non-parallel relative to each other, anchorage means affixed to the body, an element connected with the anchorage means at one end of the element, means for releasably holding keys at an opposite end of the element, the body forming a first cubic structure, the first cubic structure including at least three sides, faces matingly associated in parallel relationship with the surfaces thereby to secure photographs between the surfaces and the mating parallel faces, the faces forming a second structure, the second structure including a bottom wall, and wherein the second structure includes a protrusion, the protrusion being a locking means, and wherein the first cubic structure includes a recess, the recess being a locking element, and wherein the locking means and locking element interengage thereby to secure by snap action the two structures together.

2. An article as claimed in claim 1 wherein the interengaging locking means and locking elements are respectively a protruding element and a recessed element.

3. An article as claimed in claim 2 wherein the recessed element extends at least partly about the periphery of the planar surface.

4. An article as claimed in claim 3 wherein the anchorage means is located in the top wall of the first cubic structure.

5. An article for holding multiple photographs comprising a body having a first surface for supporting at least a first photograph, a second surface for supporting a second photograph and wherein the two respective surfaces are non-parallel relative to each other, anchorage means affixed to the body, an element connected with the anchorage means at one end of the element, and means for releasably holding keys at an opposite end of the element, wherein the first and second surfaces and at least one additional surface, which is non-parallel relative to at least one of the first and second surfaces, form a three dimensional structure and the first and second faces forms a second structure, the three dimensional structure forming a mating structure and wherein the three dimensional structure has at least a top wall and wherein the second structure has a bottom wall so that when the two structures are in mating engagement, the structures form a relatively closed construction, and wherein the second structure includes locking means, and wherein the three dimensional structure includes locking elements and wherein the locking means and locking elements and interengage by snap action thereby to secure the two structures together.

6. An article as claimed in claim 5 wherein the interengaging locking means and locking elements are respectively a protruding element and a recessed element.

7. An article as claimed in claim 6 wherein the recessed element extends at least partly about the periphery of the first and second surfaces.

8. An article as claimed in claim 5 wherein the structures are cubic.

* * * * *